US007066056B1

(12) United States Patent
Hsieh

(10) Patent No.: US 7,066,056 B1
(45) Date of Patent: Jun. 27, 2006

(54) RATCHET TOOL

(76) Inventor: Chih-Ching Hsieh, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 11/228,436

(22) Filed: Sep. 19, 2005

(51) Int. Cl.
*B25B 13/46* (2006.01)

(52) U.S. Cl. ..... 81/63.2; 81/60; 81/61; 81/62; 81/63; 81/63.1

(58) Field of Classification Search ..... 81/60, 81/61, 62, 63, 63.1, 63.2

See application file for complete search history.

(56) References Cited

U.S. PATENT DOCUMENTS 3,227,015 A * 1/1966 Tremblay ..... 81/177.2

* cited by examiner

*Primary Examiner*—Lee D. Wilson
*Assistant Examiner*—Shantese McDonald

(57) ABSTRACT

A ratchet socket tool includes a socket having a toothed protrusion extending axially from an end thereof and a tube is mounted on the first end of the socket. A driving member rotatably inserts into the tube and has a passage defined axially therethrough and a recess is defined in an inner periphery of the passage so that a pawl is movably engaged with the recess and has a toothed surface for being engaged with the toothed protrusion of the socket. A biasing member has a first end engaged with a notch defined in an inner periphery of the tube and a second end of the biasing member extends through a hole defined through a wall of the driving member and engaged with a concavity in the pawl so as to push the pawl to engage with the toothed protrusion.

8 Claims, 7 Drawing Sheets

RATCHET TOOL

FIELD OF THE INVENTION

The present invention relates to a hand tool and more particularly, to a ratchet tool allowing the user to rotate the object without removing the tool from the object.

BACKGROUND OF THE INVENTION

A conventional socket generally includes a tubular body with a rectangular recess in a first end so that a wrench can be connected with the rectangular recess, and a polygonal recess in a second end of the tubular body so that an object is engaged with the polygonal recess. The user rotates the wrench to rotate the socket to tighten or loosen the object. However, if there are other objects located beside the object to be tightened or loosened, the wrench cannot rotate continuously so that the user has to remove the wrench from the socket and re-connect the socket at desired angle. The user can also remove the socket from the object and re-cap the object at desired angle so that the handle is able to rotate. These two ways of use take too much time.

The present invention intends to provide a ratchet hand tool that allows the user to rotate the socket reciprocally by the ratchet mechanism so as to conveniently and quickly tighten or loosen the object.

SUMMARY OF THE INVENTION

The present invention relates to a ratchet socket tool which includes a socket having a toothed protrusion extending axially from a first end thereof and a polygonal is defined in a second end of the socket. A tube is mounted on the first end of the socket and a notch is defined in an inner periphery thereof. A driving member has a fist end rotatably inserting into a central passage of the tube and a passage is defined axially through the driving member. A second end of the driving member is connected with a handle so as to rotate the tool. A recess is defined in an inner periphery of the passage and a pawl is movably engaged with the recess. The pawl has a toothed surface which is engaged with the toothed protrusion of the socket. A biasing member has a first end engaged with the notch in the tube and a second end of the biasing member extends through a hole defined through a wall of the driving member and is engaged with a concavity defined in the pawl and located opposite to the toothed surface.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
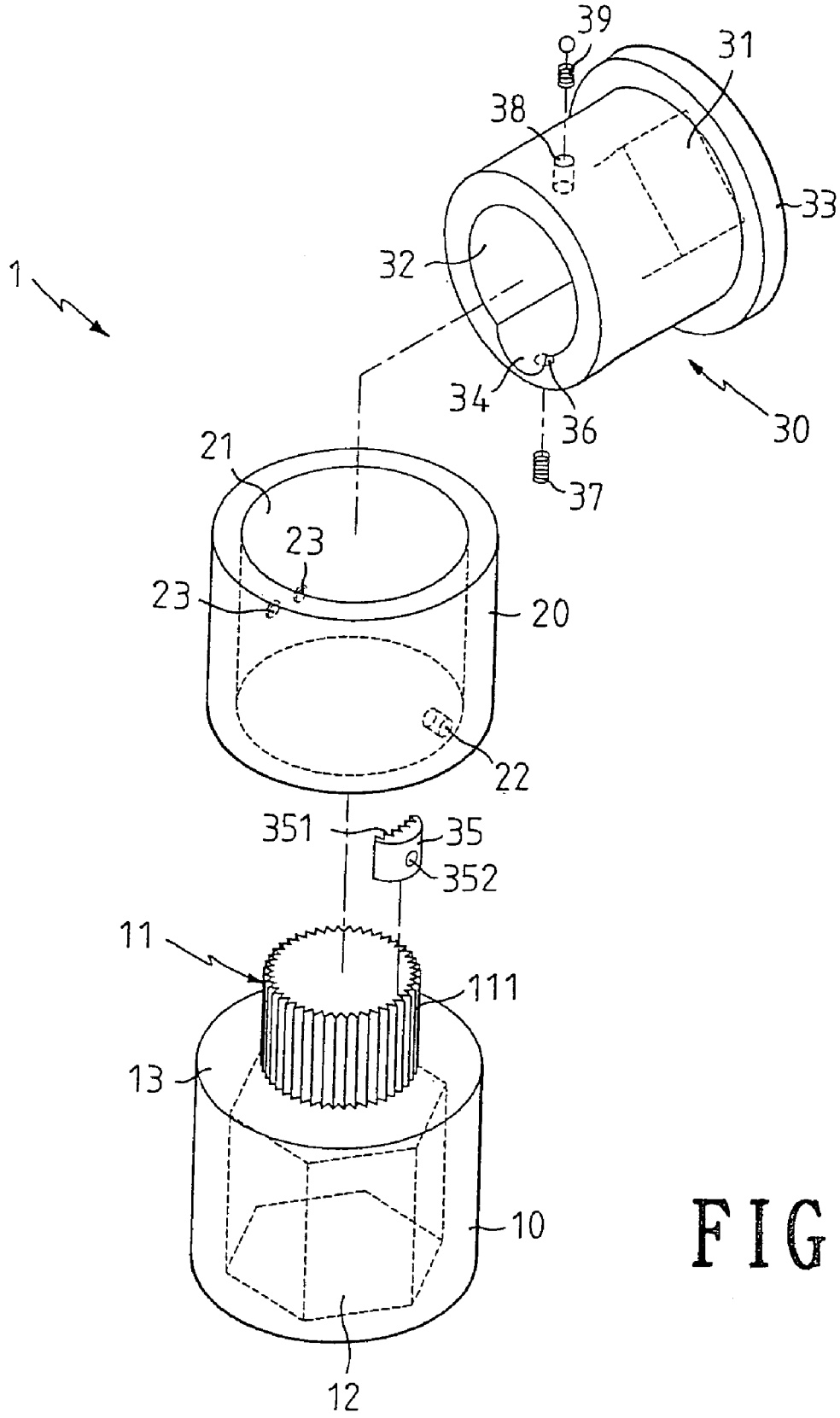
FIG. 1 is an exploded view to show the ratchet socket hand tool of the present invention.
Figure 2:
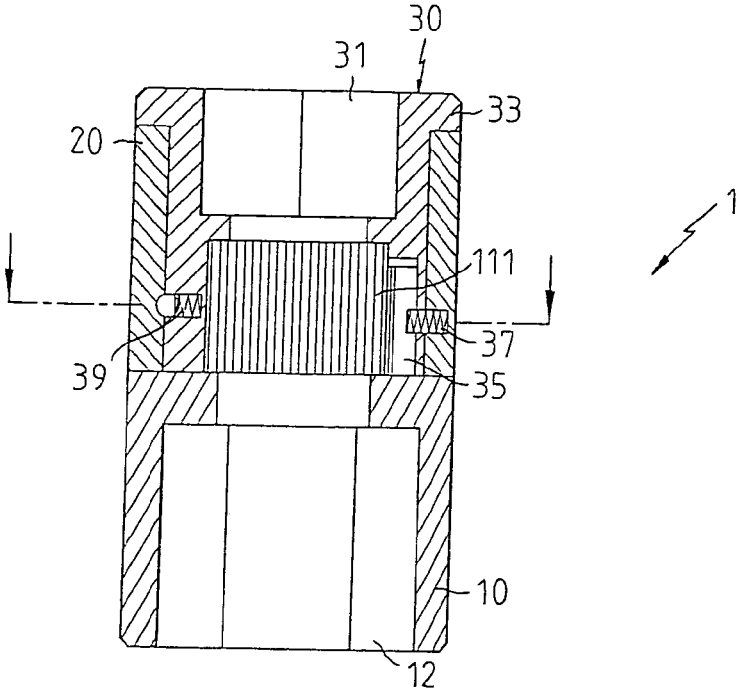
FIG. 2 is a cross sectional view of the ratchet socket hand tool of the present invention.

Referring to FIGS. 1 and 2, the ratchet socket hand tool 1 of the present invention comprises a socket 10, a tube 20 and a driving member 30. The socket 10 has a toothed protrusion 11 extending axially from a first end thereof and a polygonal recess 12 is defined in a second end of the socket 10. The tube 20 having a central passage 21 is mounted on the end surface 13 of the first end of the socket 10 and a notch 22 is defined in an inner periphery thereof. Two positioning recesses 23 are defined in the inner periphery of the tube 20.

The driving member 30 has a fist end rotatably inserting into the central passage 21 of the tube 20 and a passage 32 is defined axially through the driving member 30. The passage 32 includes a circular inner periphery and opens to the second end of the driving member 30 and defines a rectangular opening 31 which is used to connect other tools such as a ratchet wrench. The driving member 30 has a flange 33 extending radially from the second end therefrom and the flange 33 is rested on the end surface of the tube 20. A recess 34 is defined in an inner periphery of the passage 32 and a pawl 35 is movably engaged with the recess 34. The pawl 35 has a toothed surface 351 which is engaged with the toothed protrusion 11 of the socket 10.

A biasing member 37 has a first end engaged with the notch 22 in the tube 20 and a second end of the biasing member 37 extends through a hole 36 defined through a wall of the driving member 30 and is engaged with a concavity 352 defined in the pawl 35 and located opposite to the toothed surface 351. A radial hole 38 is defined through the wall of the driving member 30 and the tube 20 includes two positioning recesses 23 defined in the inner periphery thereof. A positioning unit 39 is received in the radial hole 38 includes a biasing spring and a bead which is biased by the biasing spring and is engaged with one of the two positioning recesses 23.

Figure 3:
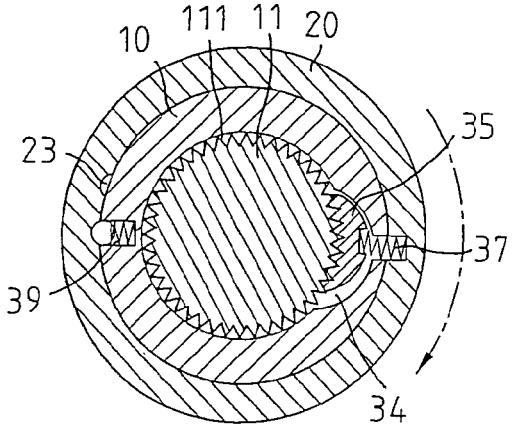
FIGS. 3 and 4 respectively show that the pawl is in contact with the inside of the recess when the driving member is rotated in two opposite directions.
Figure 4:
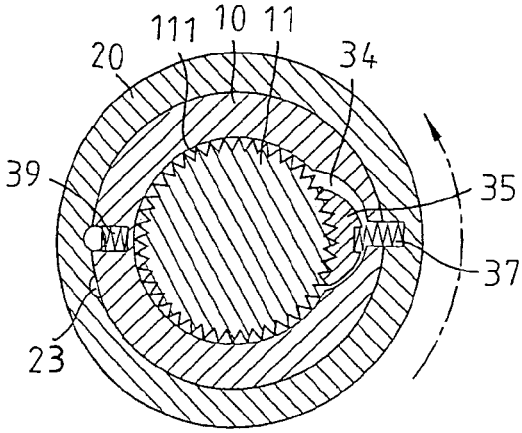

Referring to FIGS. 3 and 4, when rotating the tool connected to the second end of the driving member 30, an inside of the recess 34 is in contact with either of two ends of the pawl 35 so that a torque is output to rotate the socket 10 so as to tighten or loosen an object engaged with the polygonal recess 12 of the socket 10.

Figure 5:
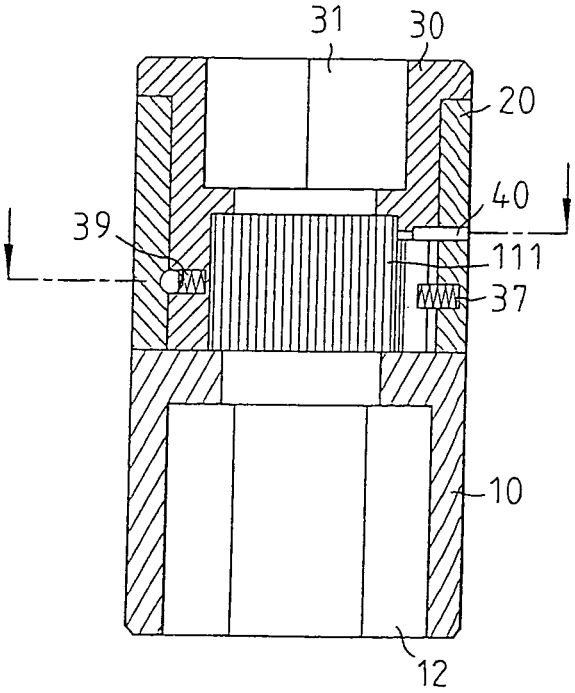
FIG. 5 is a cross sectional view of another embodiment of the ratchet socket hand tool of the present invention.
Figure 6:
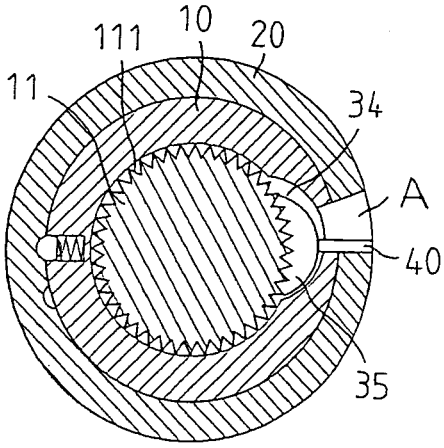
FIG. 6 is an end cross sectional view to show the pin on the pawl is moveable in the limitation hole in the tube.

FIGS. 5 and 6 show that a limitation hole "A" is defined through the wall of the tube 20 and a pin 40 is fixed to the pawl 35 so that the pin 40 is movable within the limitation hole "A" so as to limit the movement of the driving member 30.

Figure 7:
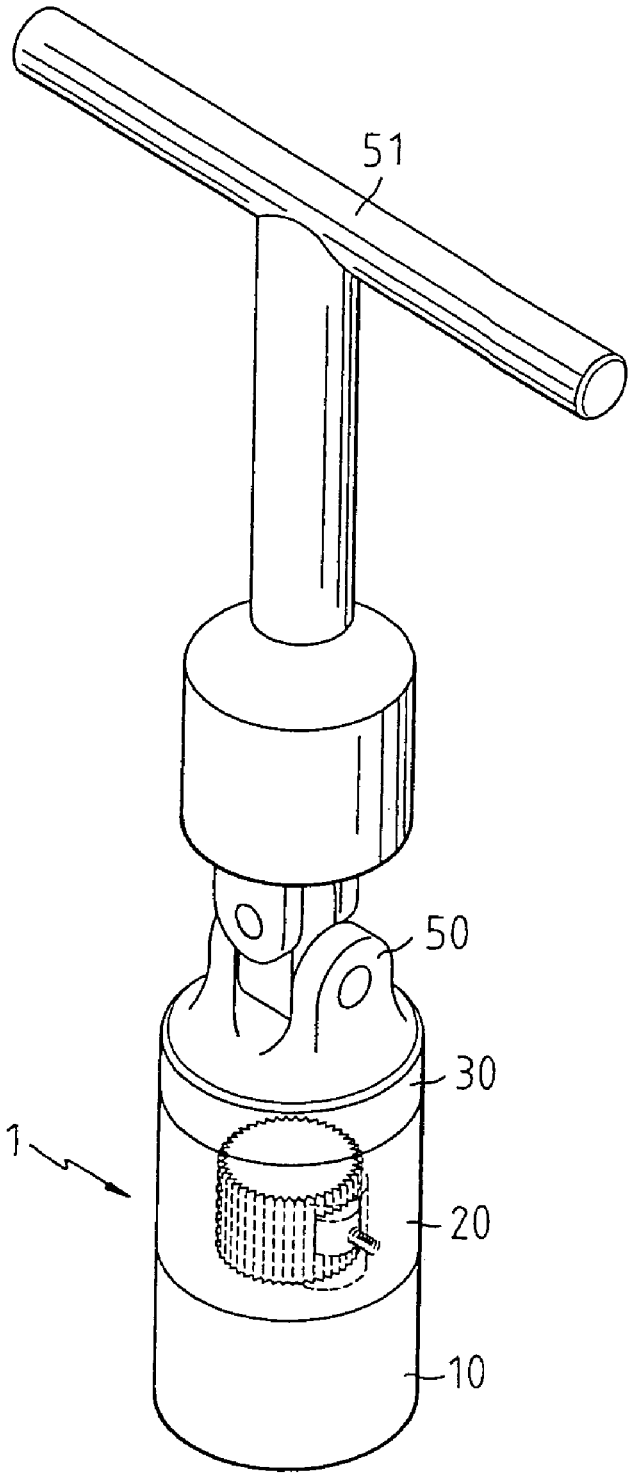
FIG. 7 shows that the socket hand tool is pivotably connected with a T-shaped bar.
Figure 8:
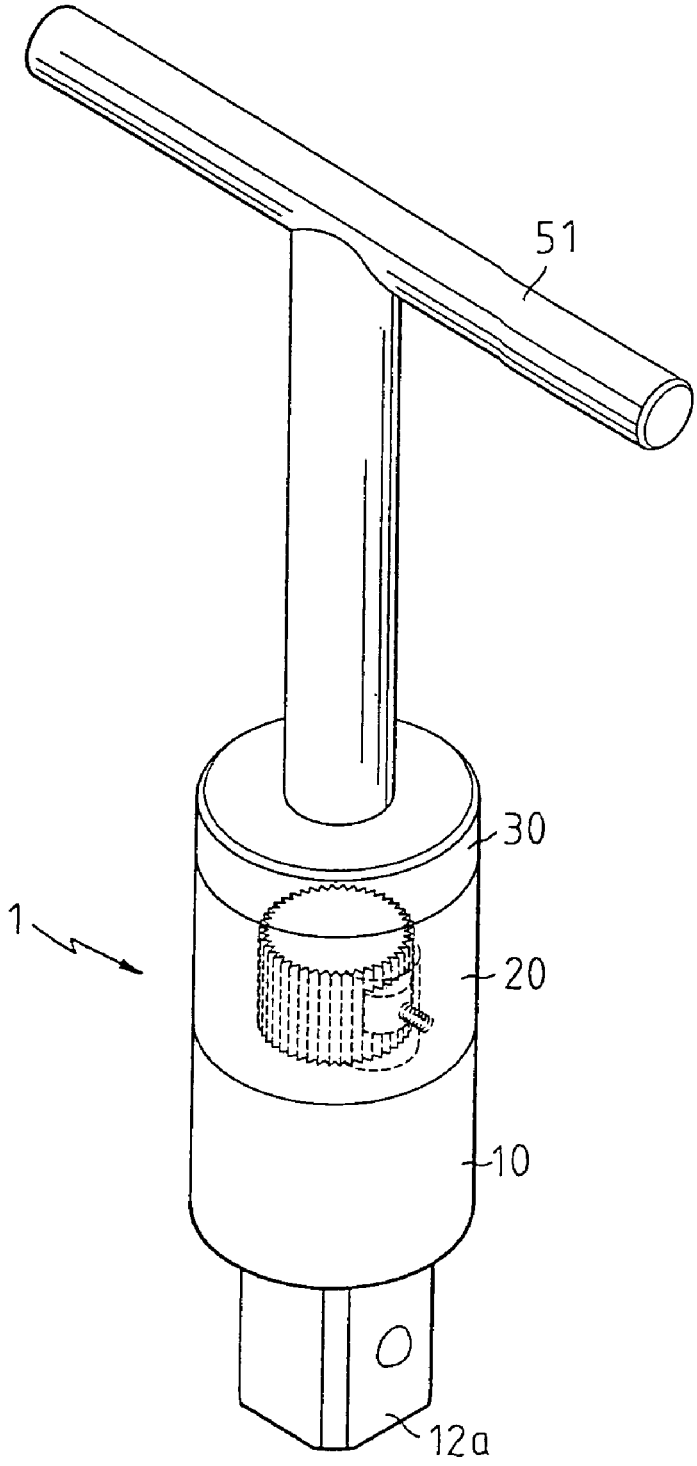
FIG. 8 shows that the socket hand tool is connected with a T-shaped bar.

FIG. 7 shows that two lugs 50 extend from the second end of the driving member 30 and are pivotably connected to a T-shaped bar 51. The T-shaped bar 51 can also be made integrally with the driving member 30 as shown in FIG. 8 and a polygonal rod 12*a* extends from the second end of the socket 10.

Figure 9:
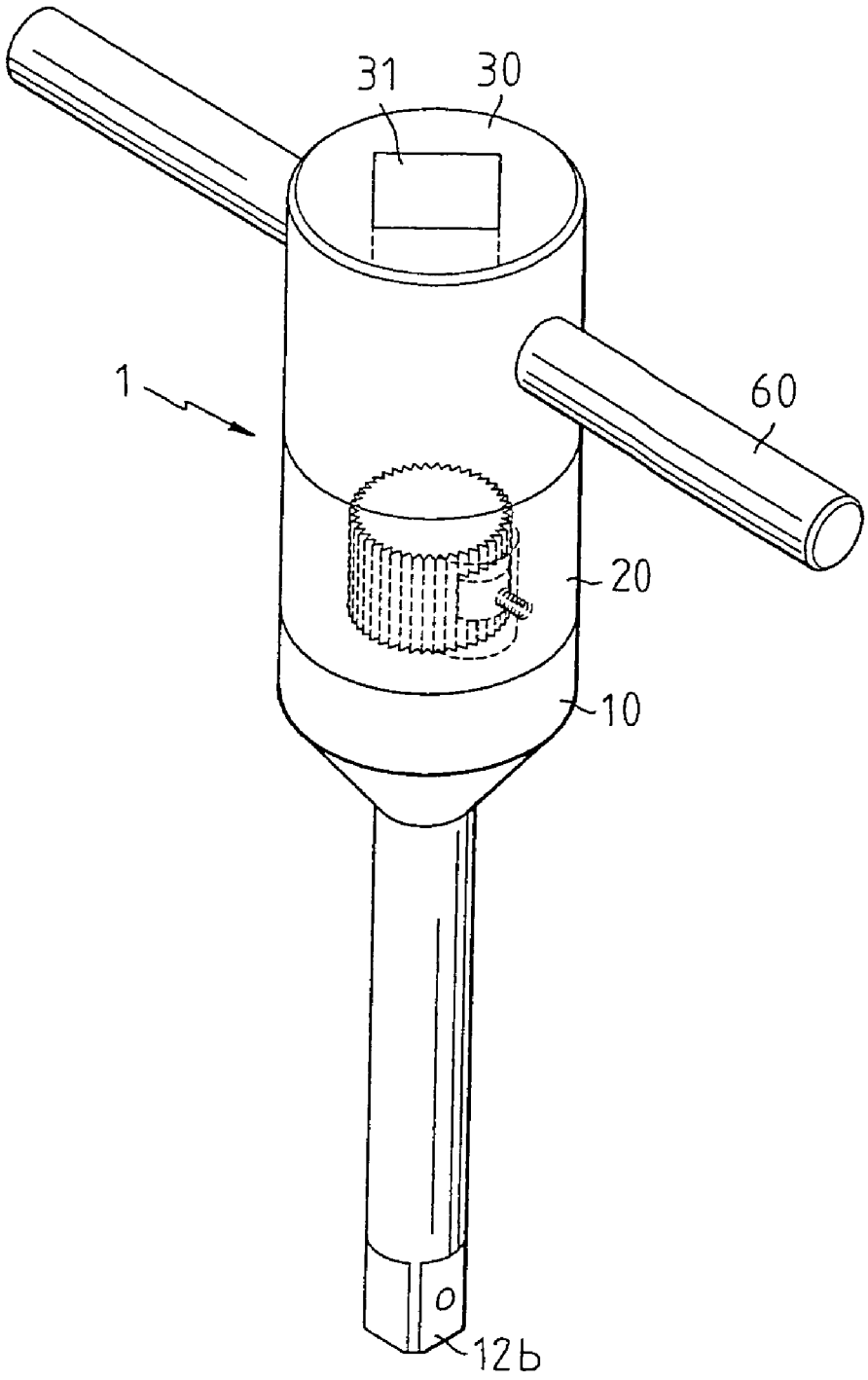
FIG. 9 shows a bar extends transversely through the driving member.
Figure 10:
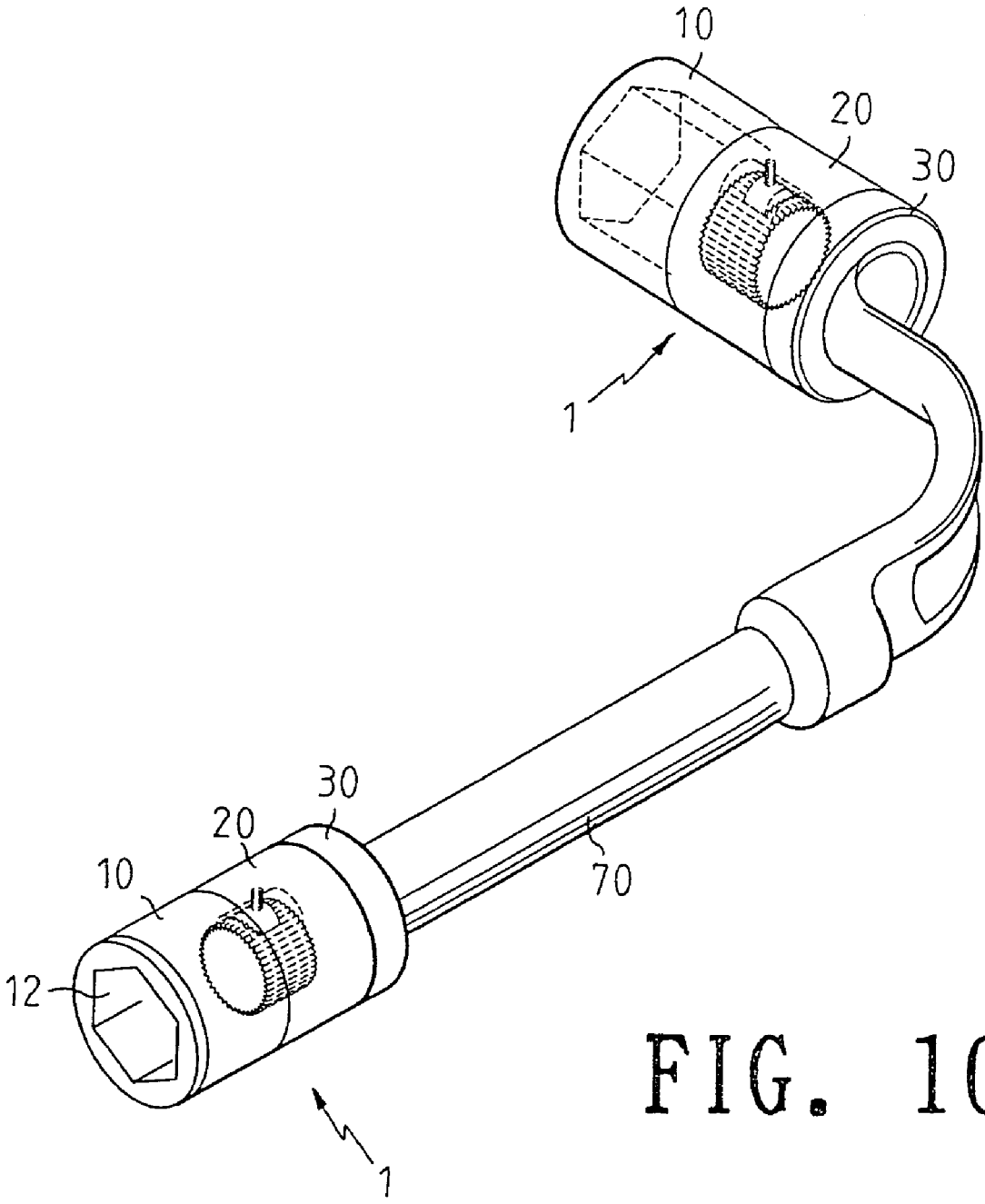
FIG. 10 shows a handle with two ratchet socket tools on two ends thereof.

A bar 60 may transversely extend through the driving member 30 as shown in FIG. 9 so that the user may rotate the bar 60 to output a torque. Again, a polygonal rod 12*b* is connected to the second end of the socket 10. FIG. 10 shows that an L-shaped handle 70 has two ratchet socket hand tools 1 connected to two ends thereof.

While we have shown and described the embodiment in accordance with the present invention, it should be clear to those skilled in the art that further embodiments may be made without departing from the scope of the present invention.

What is claimed is:

1. A ratchet socket tool comprising:

a socket having a toothed protrusion extending axially from a first end thereof and a polygonal recess defined in a second end of the socket;

a tube mounted on the first end of the socket and a notch defined in an inner periphery thereof;

a driving member having a fist end rotatably inserting into a central passage of the tube and a passage defined axially through the driving member, a second end of the driving member adapted to be connected with a handle, a recess defined in an inner periphery of the passage and a pawl movably engaged with the recess, the pawl having a toothed surface which is engaged with the toothed protrusion of the socket, and a biasing member having a first end engaged with the notch in the tube and a second end of the biasing member extending through a hole defined through a wall of the driving member and engaged with a concavity defined in the pawl and located opposite to the toothed surface.

2. The tool as claimed in claim 1, wherein the passage opens to the second end of the driving member and defines a rectangular opening.

3. The tool as claimed in claim 1, wherein the driving member has a flange extending radially from the second end therefrom and the flange is rested on the an end surface of the tube.

4. The tool as claimed in claim 1, wherein a radial hole is defined through the wall of the driving member and the tube includes two positioning recesses defined in the inner periphery thereof, a positioning unit is received in the radial hole includes a biasing spring and a bead which is biased by the biasing spring and is engaged with one of the two positioning recesses.

5. The tool as claimed in claim 1, wherein a limitation hole is defined through the wall of the tube and a pin is fixed to the pawl, the pin is movable within the limitation hole.

6. The tool as claimed in claim 1, wherein two lugs extend from the second end of the driving member and are adapted to be pivotably connected to a T-shaped bar.

7. The tool as claimed in claim 1, wherein a bar transversely extends through the driving member.

8. The tool as claimed in claim 1, wherein a polygonal rod is connected to the second end of the socket.

* * * * *